US010049630B2

(12) United States Patent
Kwak et al.

(10) Patent No.: US 10,049,630 B2
(45) Date of Patent: Aug. 14, 2018

(54) IMAGE CORRECTING UNIT AND A LIQUID CRYSTAL DISPLAY DEVICE HAVING THE SAME

(71) Applicant: SAMSUNG DISPLAY CO., LTD., Yongin-si, Gyeonggi-do (KR)

(72) Inventors: Tong Ill Kwak, Yongin-si (KR); Woon Yong Lim, Yongin-si (KR); Bong Kyun Jo, Yongin-si (KR); Ki Hyun Pyun, Yongin-si (KR); Young Uk Hwang, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 194 days.

(21) Appl. No.: 15/006,508

(22) Filed: Jan. 26, 2016

(65) Prior Publication Data

US 2016/0365043 A1 Dec. 15, 2016

(30) Foreign Application Priority Data

Jun. 11, 2015 (KR) ..... 10-2015-0082761

(51) Int. Cl.
*G09G 3/36* (2006.01)

(52) U.S. Cl.
CPC ... *G09G 3/3648* (2013.01); *G09G 2320/0209* (2013.01); *G09G 2320/0233* (2013.01); *G09G 2320/0271* (2013.01); *G09G 2360/16* (2013.01)

(58) Field of Classification Search
None
See application file for complete search history.

(56) References Cited

U.S. PATENT DOCUMENTS

2005/0052364 A1* 3/2005 Otawara ..... G09G 3/288 345/63
2007/0206262 A1* 9/2007 Zhou ..... G09G 3/344 359/267
2007/0236439 A1* 10/2007 Chen ..... G09G 3/2007 345/89

(Continued)

FOREIGN PATENT DOCUMENTS

KR 1020070097172 10/2007
KR 1020100095093 8/2010

(Continued)

*Primary Examiner* — Joseph Haley
*Assistant Examiner* — Emily Frank
(74) *Attorney, Agent, or Firm* — F. Chau & Associates, LLC

(57) ABSTRACT

An image correcting unit including: a data converting unit which receives image data, and generates display data by converting respective grayscale values which are included in the image data to high pixel data and low pixel data; and a white pixel detecting unit which detects image data lines which include not less than a first number of white grayscale values from the image data, and outputs a conversion signal when not less than a second number of the detected image data lines are successively arranged, wherein upon receiving the conversion signal from the white pixel detecting unit, the data converting unit converts the white grayscale values which are included in the successively arranged image data lines to first high pixel data and first low pixel data, wherein the first high pixel data and the first low pixel data have a different value from each other.

20 Claims, 5 Drawing Sheets

(56) References Cited

U.S. PATENT DOCUMENTS

| | | | | |
|---|---|---|---|---|
| 2010/0253664 | A1 | 10/2010 | Byun et al. | |
| 2012/0013591 | A1 | 1/2012 | Kim et al. | |
| 2016/0148576 | A1* | 5/2016 | Kato ..... | G09G 3/2007 345/211 |

FOREIGN PATENT DOCUMENTS

| | | |
|---|---|---|
| KR | 1020120009570 | 2/2012 |
| KR | 1020130074374 | 7/2013 |

* cited by examiner

FIG. 4

Im

| | | | | | | | | |
|---|---|---|---|---|---|---|---|---|
| L1 → | Vb | Vm | Vm | Vw | Vm | Vw | Vm | Vm |
| L2 → | Vb | Vm | Vm | Vm | Vm | Vm | Vm | Vm |
| L3 → | Vm | Vm | Vm | Vw | Vw | Vw | Vw | Vm |
| L4 → | Vm | Vm | Vm | Vw | Vw | Vw | Vw | Vm |
| L5 → | Vm | Vm | Vm | Vw | Vw | Vw | Vm | Vm |
| L6 → | Vm | Vm | Vm | Vm | Vm | Vm | Vm | Vm |
| L7 → | Vm | Vm | Vm | Vw | Vw | Vw | Vm | Vm |

FIG. 5

Dd

| | | | | | | | | | | | | | | | | |
|---|---|---|---|---|---|---|---|---|---|---|---|---|---|---|---|---|
| L1 → | Hb | Lb | Hm | Lm | Hm | Lm | H2 | L2 | Hm | Lm | H2 | L2 | Hm | Lm | Hm | Lm |
| L2 → | Hb | Lb | Hm | Lm | Hm | Lm | Hm | Lm | Hm | Lm | Hm | Lm | Hm | Lm | Hm | Lm |
| L3 → | Hm | Lm | Hm | Lm | Hm | Lm | H1 | L1 | H1 | L1 | H1 | L1 | H1 | L1 | Hm | Lm |
| L4 → | Hm | Lm | Hm | Lm | Hm | Lm | H1 | L1 | H1 | L1 | H1 | L1 | H1 | L1 | Hm | Lm |
| L5 → | Hm | Lm | Hm | Lm | Hm | Lm | H1 | L1 | H1 | L1 | H1 | L1 | Hm | Lm | Hm | Lm |
| L6 → | Hm | Lm | Hm | Lm | Hm | Lm | Hm | Lm | Hm | Lm | Hm | Lm | Hm | Lm | Hm | Lm |
| L7 → | Hm | Lm | Hm | Lm | Hm | Lm | H2 | L2 | H2 | L2 | H2 | L2 | Hm | Lm | Hm | Lm |

IMAGE CORRECTING UNIT AND A LIQUID CRYSTAL DISPLAY DEVICE HAVING THE SAME

CROSS-REFERENCE TO RELATED APPLICATION

This application claims priority to Korean Patent Application No. 10-2015-0082761, filed on Jun. 11, 2015, in the Korean Intellectual Property Office, the disclosure of which is incorporated by reference herein in its entirety.

TECHNICAL FIELD

The present invention relates to an image correcting unit and a liquid crystal display device having the image correcting unit.

DISCUSSION OF THE RELATED ART

Generally, a liquid crystal display device includes a first substrate having pixel electrodes, a second substrate having common electrodes, and a liquid crystal layer interposed between the first and second substrates.

The liquid crystal display device generates electric fields in the liquid crystal layer by applying a voltage across the pixel and common electrodes, and determines the direction of liquid crystal molecules in the liquid crystal layer by using the electric field, thereby controlling polarization of incident light to display images.

In the liquid crystal display device of a vertical alignment (VA) mode, a unit pixel has two sub pixels, one being a high pixel, the other being a low pixel.

However, in the liquid crystal display devices mentioned above, when a plurality of pixels in a concentrated area emit light at a maximum brightness, the pixels which are positioned adjacent to that area tend to emit at a brightness higher than normal.

SUMMARY

An exemplary embodiment of the present invention provides an image correcting unit which is capable of minimizing erroneous light emission and a liquid crystal display device having the image correcting unit.

An image correcting unit according to an exemplary embodiment of the present invention comprises: a data converting unit which receives image data, and generates display data by converting respective grayscale values which are included in the image data to high pixel data and low pixel data; and a white pixel detecting unit which detects image data lines which include not less than a first number of white grayscale values from the image data, and outputs a conversion signal when not less than a second number of the detected image data lines are successively arranged, wherein upon receiving the conversion signal from the white pixel detecting unit, the data converting unit converts the white grayscale values which are included in the successively arranged image data lines to first high pixel data and first low pixel data, wherein the first high pixel data and the first low pixel data have a different value from each other.

In addition, the data converting unit converts the white grayscale values which are not included in the successively arranged image data lines to second high pixel data and second low pixel data, wherein the second high pixel data and the second low pixel data have the same value as each other.

In addition, the low pixel data which is included in the display data has a value not greater than the high pixel data which is included in the display data.

In addition, when the data converting unit does not receive the conversion signal from the white pixel detecting unit, the data converting unit converts all white grayscale values which are included in the image data to second high pixel data and second low pixel data, wherein the second high pixel data and the second low pixel data have the same value as each other.

In addition, the first low pixel data has a value smaller than the second low pixel data.

In addition, the first high pixel data has the same value as the second high pixel data.

In addition, the image correcting unit further comprises a memory which stores the image data.

A liquid crystal display device according to an exemplary embodiment of the present invention comprises: a plurality of pixels which have high pixels and low pixels, respectively; an image correcting unit which receives image data and converts the image data to display data; and a data driving unit which generates a data signal which corresponds to the display data and supplies the data signal to the pixels, wherein the image correcting unit includes: a data converting unit which receives the image data, and generates the display data by converting respective grayscale values which are included in the image data to high pixel data and low pixel data; and a white pixel detecting unit which detects image data lines which include not less than a first number of white grayscale values from the image data, and outputs a conversion signal when not less than a second number of the detected image data lines are successively arranged, wherein upon receiving the conversion signal from the white pixel detecting unit, the data converting unit converts the white grayscale values which are included in the successively arranged image data lines to first high pixel data and first low pixel data, wherein the first high pixel data and the first low pixel data have a different value from each other.

In addition, the data converting unit converts the white grayscale values which are not included in the successively arranged image data lines to second high pixel data and second low pixel data, wherein the second high pixel data and the second low pixel data have the same value as each other.

In addition, the low pixel data which is included in the display data has a value not greater than the high pixel data which is included in the display data.

In addition, when the data converting unit does not receive the conversion signal from the white pixel detecting unit, the data converting unit converts all white grayscale values which are included in the image data to second high pixel data and second low pixel data, wherein the second high pixel data and the second low pixel data have the same value as each other.

In addition, the first low pixel data has a value smaller than the second low pixel data.

In addition, the first high pixel data has the same value as the second high pixel data.

In addition, the image correcting unit further comprises a memory which stores the image data.

An image correcting unit according to an exemplary embodiment of the present invention comprises: a white pixel detecting unit that receives image data, wherein the image data includes a plurality of image data lines, each image data line including a plurality of grayscale values, wherein the white pixel detecting unit detects image data lines having a number of white grayscale values greater than or equal to a first number and outputs a conversion signal when a number of the detected image data lines that are sequentially arranged is greater than or equal to a second number; and a data converting unit that receives the conversional signal and converts the white grayscale values in the detected image data lines that are sequentially arranged to first high pixel data and first low pixel data.

In addition, the first high pixel data and the first low pixel data are different from each other.

In addition, the data converting unit converts the white grayscale values of the other image data lines to second high pixel data and second low pixel data.

In addition, the second high pixel data and the second low pixel data are the same as each other.

In addition, the first number is less than the second number.

In addition, the data converting unit outputs the converted white grayscale values as display data.

BRIEF DESCRIPTION OF THE DRAWINGS

FIG. 4 is a diagram showing image data according to an exemplary embodiment of the present invention.

FIG. 5 is a diagram showing display data according to an exemplary embodiment of the present invention.

DETAILED DESCRIPTION OF THE EMBODIMENTS

Figure 1:
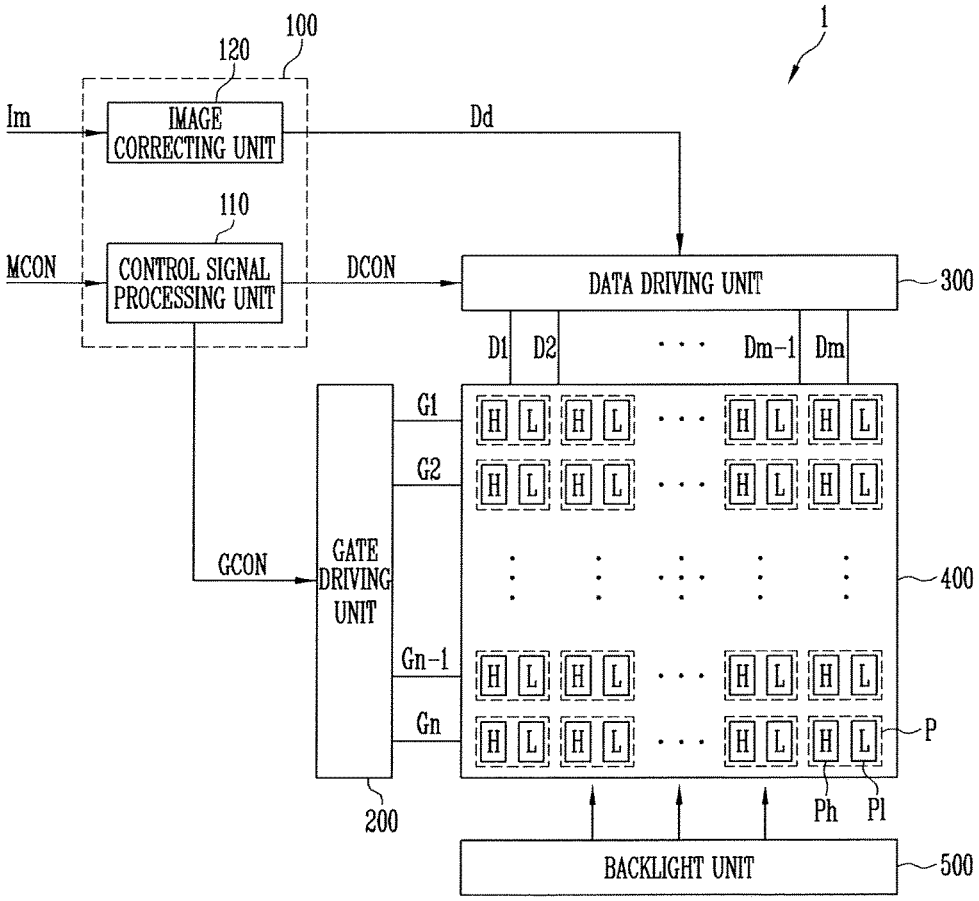
FIG. 1 is a diagram showing a liquid crystal display device according to an exemplary embodiment of the present invention.

Hereinafter, exemplary embodiments of the present invention are described in connection with the appended drawings. However, the present invention can be embodied in various different implementations, and should not be construed as being limited to the embodiments set forth herein. When a first element is said to be connected to a second element in the following description, the first element may be directly connected to the second element or the first and second elements may be connected to each other via other elements between them. In the drawings, dimensions of elements may be exaggerated for clarity. Like reference numerals may refer to like elements throughout the specification.

Figure 2A:
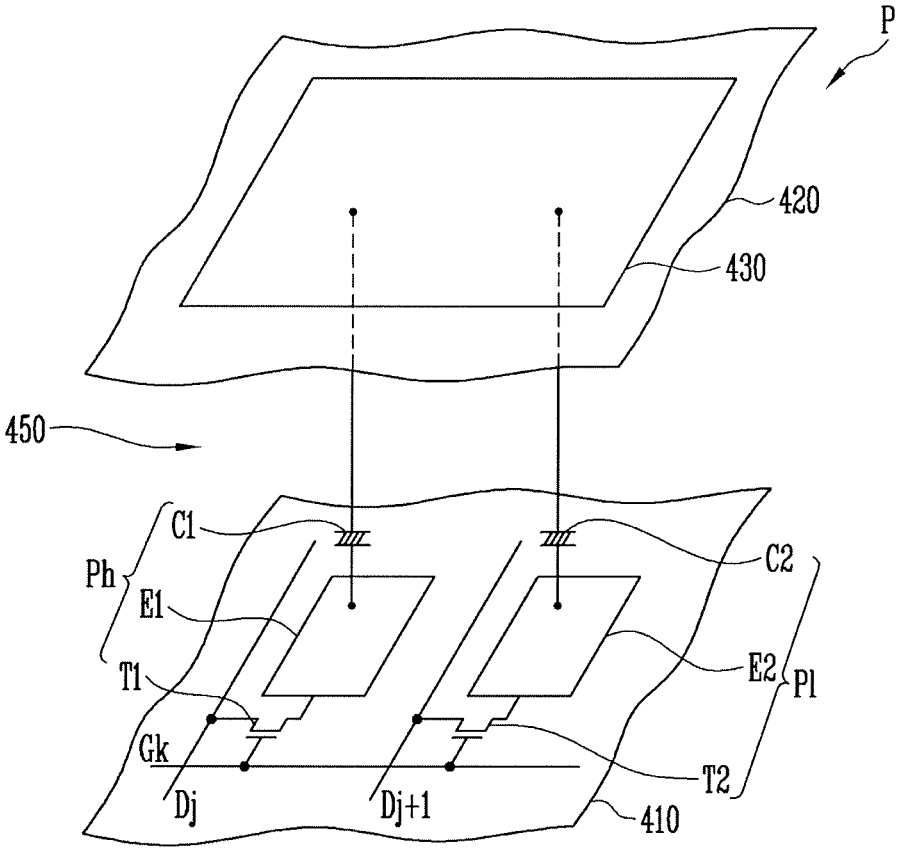
FIG. 2A is an equivalent circuit diagram of a pixel according to an exemplary embodiment of the present invention.
Figure 2B:
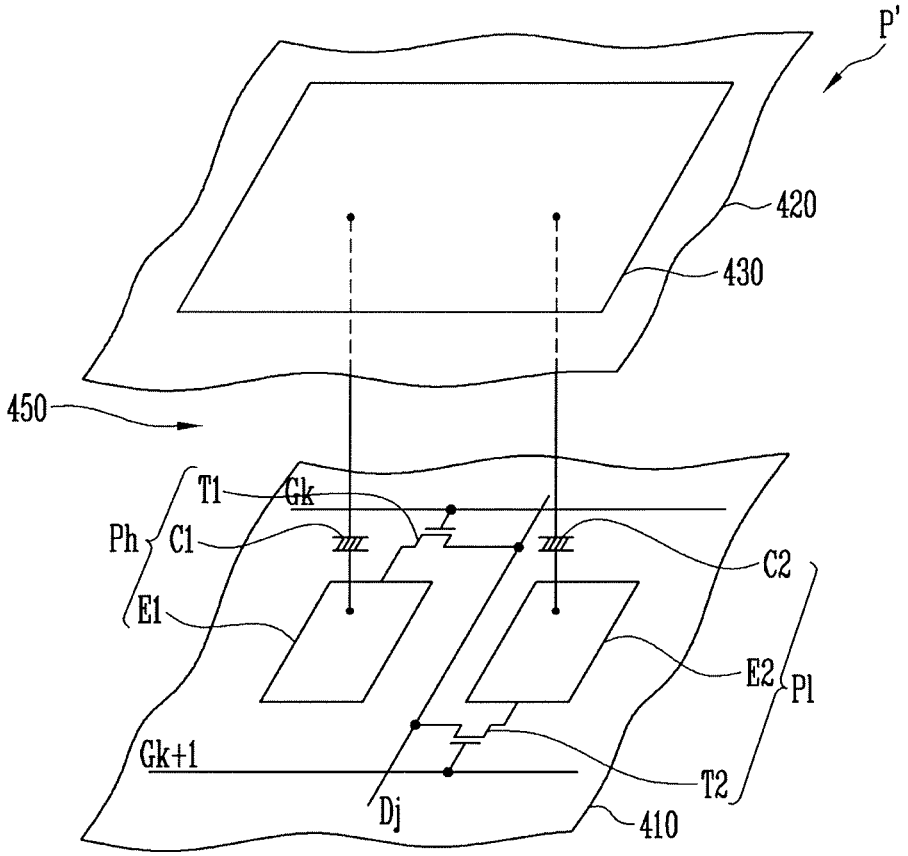
FIG. 2B is an equivalent circuit diagram of a pixel according to an exemplary embodiment of the present invention.

FIG. 1 is a diagram showing a liquid crystal display device according to an exemplary embodiment of the present invention, FIG. 2A is an equivalent circuit diagram of a pixel according to an exemplary embodiment of the present invention, and FIG. 2B is an equivalent circuit diagram of a pixel according to an exemplary embodiment of the present invention.

When referring to FIG. 1, a liquid crystal display device 1 according to an exemplary embodiment of the present invention comprises a timing control unit 100, a gate driving unit 200, a data driving unit 300, a liquid crystal display panel 400 and a backlight unit 500.

The timing control unit 100 can receive image data Im and a main control signal MCON from an external graphic control unit.

In addition, the timing control unit 100 can convert the image data Im to display data Dd and output the display data Dd, and can also output a data control signal DCON and a gate control signal GCON in response to the main control signal MCON.

For example, the timing control unit 100 can include a control signal processing unit 110 and an image correcting unit 120.

The control signal processing unit 110 can receive the main control signal MCON, and generate the data control signal DCON and the gate control signal GCON by using the main control signal MCON.

For example, the main control signal MCON can include a vertical synchronous signal, a horizontal synchronous signal, a main clock signal, a data enable signal, etc.

The image correcting unit 120 can receive the image data Im and generate the display data Dd by using the image data Im.

A detailed explanation on the image correcting unit 120 will be given later with reference to FIG. 3.

The gate driving unit 200 can receive the gate control signal GCON from the timing control unit 100, and output a gate signal to the liquid crystal display panel 400 corresponding to the gate control signal GCON.

For example, the gate driving unit 200 can supply the gate signal to pixels P of the liquid crystal display panel 400 via a plurality of gate lines G1-Gn which are connected to the pixels P.

The data driving unit 300 can receive the display data Dd and the data control signal DCON from the timing control unit 100 and generate data signals which have an analog voltage corresponding to the display data Dd.

In addition, the data driving unit 300 can output the generated data signals to the liquid crystal display panel 400.

For example, the data driving unit 300 can supply the data signals to the pixels P of the liquid crystal display panel 400 via a plurality of data lines D1-Dm which are connected to the pixels P.

The liquid crystal display panel 400 can receive the gate signal and the data signal from the gate driving unit 200 and the data driving unit 300, respectively, and display an image by using light which is supplied from the backlight unit 500.

The liquid crystal display panel 400 can include a first substrate 410, a second substrate 420, a common electrode 430, and a liquid crystal layer 450 which is interposed between the first substrate 410 and the second substrate 420.

In addition, the liquid crystal display panel 400 can also include a plurality of pixels P, and a plurality of gate lines G1-Gn and data lines D1-Dm which are connected to the pixels P.

For example, the gate lines G1-Gn, the data lines D1-Dm, and the pixels P can be positioned on the first substrate 410.

In addition, the common electrode 430 can be positioned on the second substrate 420.

When referring to FIG. 2A, each of the pixels P can include a pair of sub pixels Ph, Pl. For example, the sub pixels Ph, Pl refer to a high pixel Ph and a low pixel Pl, respectively.

In addition, each sub pixel Ph, Pl can include a transistor, a pixel electrode, and a liquid crystal capacitor.

For example, the high pixel Ph can include a first transistor T1, a first pixel electrode E1 and a first liquid crystal capacitor C1, and the low pixel Pl can include a second transistor T2, a second pixel electrode E2 and a second liquid crystal capacitor C2.

For example, in FIG. 2A, there is shown a "1G2D" structure in which one unit pixel P is connected to one gate line Gk and two data lines Dj, Dj+1.

The first transistor T1 can be connected between the first pixel electrode E1 and a j'th data line Dj, and a gate electrode of the first transistor T1 can be connected to a k'th gate line Gk.

Therefore, the first transistor T1 can be turned on when a gate signal is supplied to the k'th gate line Gk, and deliver the data signal of the j'th data line Dj to the first pixel electrode E1.

The first liquid crystal capacitor C1 has two terminals, for example, the first pixel electrode E1 and the common electrode 430, and the liquid crystal layer 450 between the first pixel electrode E1 and the common electrode 430 can act as a dielectric.

The second transistor T2 can be connected between the second pixel electrode E2 and a (j+1)'th data line Dj+1, and a gate electrode of the second transistor T2 can be connected to the k'th gate line Gk.

Therefore, the second transistor T2 can be turned on when a gate signal is supplied to the k'th gate line Gk, and deliver the data signal of the (j+1)'th data line Dj+1 to the second pixel electrode E2.

The second liquid crystal capacitor C2 has two terminals, for example, the second pixel electrode E2 and the common electrode 430, and the liquid crystal layer 450 between the second pixel electrode E2 and the common electrode 430 can act as a dielectric.

In addition, in FIG. 2B, there is shown a "2G1D" structure in which one unit pixel P' is connected to two gate lines Gk, Gk+1 and one data line Dj.

A first transistor T1 can be connected between a first pixel electrode E1 and a j'th data line Dj, and a gate electrode of the first transistor T1 can be connected to a k'th gate line Gk.

Therefore, the first transistor T1 can be turned on when a gate signal is supplied to the k'th gate line Gk, and deliver the data signal of the j'th data line Dj to the first pixel electrode E1.

A first liquid crystal capacitor C1 has two terminals, for example, the first pixel electrode E1 and a common electrode 430, and a liquid crystal layer 450 between the first pixel electrode E1 and the common electrode 430 can act as a dielectric.

A second transistor T2 can be connected between a second pixel electrode E2 and the j'th data line Dj, and a gate electrode of the second transistor T2 can be connected to a (k+1)'th gate line Gk+1.

Therefore, the second transistor T2 can be turned on when a gate signal is supplied to the (k+1)'th gate line Gk+1, and deliver the data signal of the j'th data line Dj to the second pixel electrode E2.

A second liquid crystal capacitor C2 has two terminals, for example, the second pixel electrode E2 and the common electrode 430, and the liquid crystal layer 450 between the second pixel electrode E2 and the common electrode 430 can act as a dielectric.

The backlight unit 500 can be positioned under the liquid crystal display panel 400 and supply light to the liquid crystal display panel 400.

Figure 3:
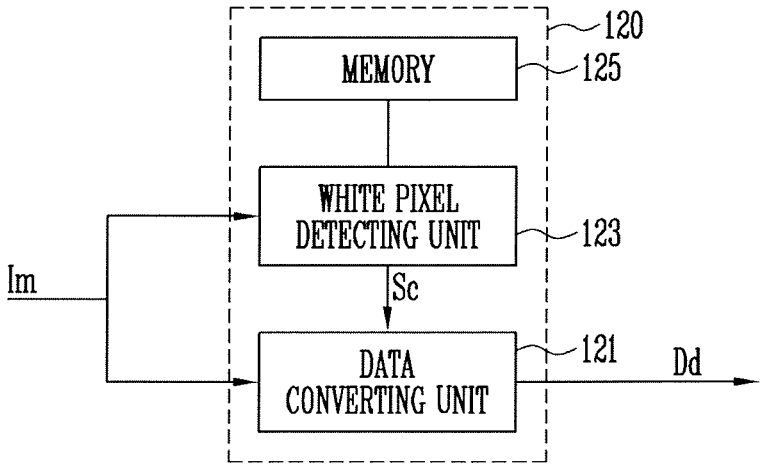
FIG. 3 is a diagram showing an image correcting unit according to an exemplary embodiment of the present invention.

FIG. 3 is a diagram showing an image correcting unit according to an exemplary embodiment of the present invention.

When referring to FIG. 3, the image correcting unit 120 according to an exemplary embodiment of the present invention can include a data converting unit 121 and a white pixel detecting unit 123.

In addition, the image correcting unit 120 according to an exemplary embodiment of the present invention can include a memory 125.

The data converting unit 121 can receive the image data Im, and generate the display data Dd by using the image data Im.

For example, the data converting unit 121 can convert the image data Im to the display data Dd by converting respective grayscale values which are included in the image data Im to high pixel data and low pixel data.

The white pixel detecting unit 123 can output a conversion signal Sc by analyzing the image data Im, when the image data Im corresponds to a specific condition.

For example, in determining whether the conversion signal Sc is to be outputted, the specific condition can be set as the case where, for image data Im of a frame, not less than a preset second number of a plurality of image data lines, which include not less than a preset first number of white grayscale values, are successively arranged.

In other words, the white pixel detecting unit 123 can receive image data Im of a frame, detect image data lines which include not less than a preset first number of white grayscale values from the image data Im, and output the conversion signal Sc when not less than a preset second number of the detected image data lines are successively arranged.

The conversion signal Sc which is outputted from the white pixel detecting unit 123 can be delivered to the data converting unit 121.

The data converting unit 121, upon receiving the conversion signal Sc, can convert the white grayscale values, which are included in the successively arranged image data lines, to first high pixel data and first low pixel data which have different values from each other.

In addition, the data converting unit 121 can convert the white grayscale values which are not included in the successively arranged image data lines to second high pixel data and second low pixel data which have the same values.

In addition, the data converting unit 121, upon failing to receive the conversion signal Sc from the white pixel detecting unit 123 during a preset time period, can convert all white grayscale values which are included in the image data Im to second high pixel data and second low pixel data which have the same values.

Figure 6:
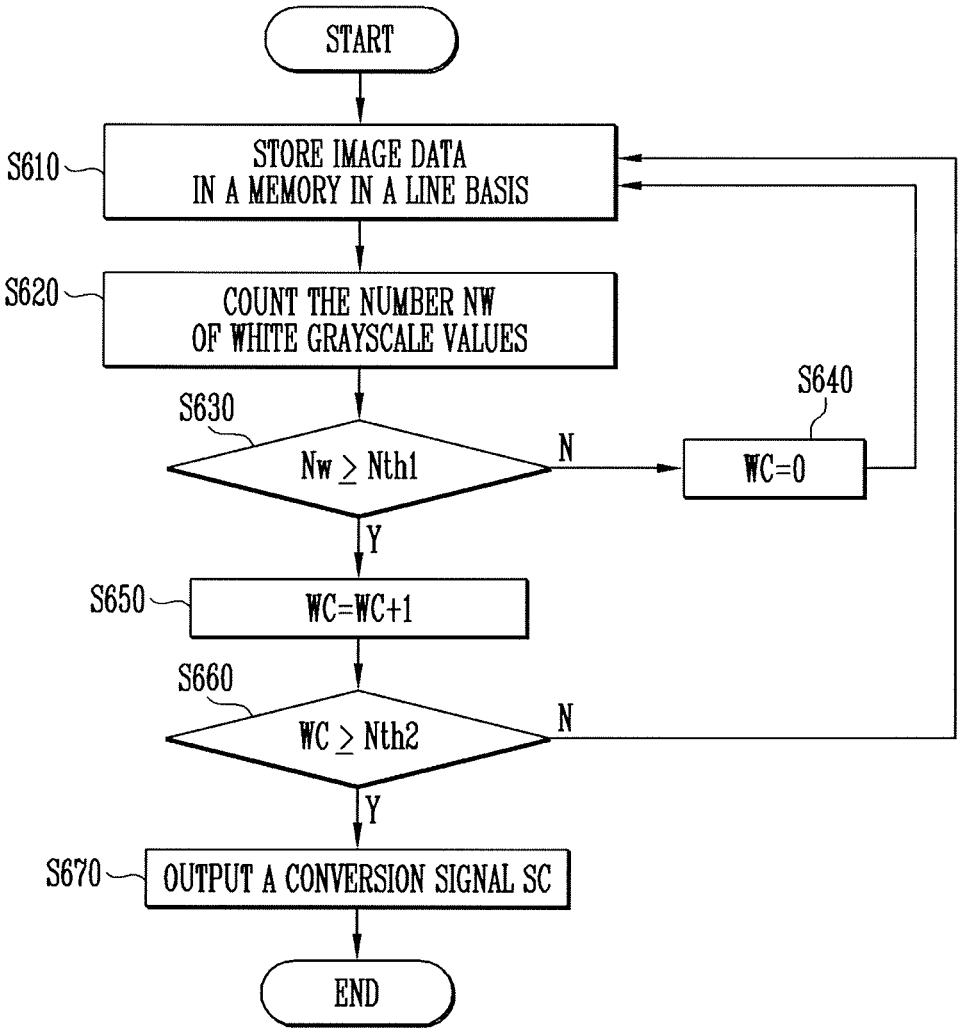
FIG. 6 is a flowchart for explaining the operation of a white pixel detecting unit according to an exemplary embodiment of the present invention.

FIG. 4 is a diagram showing the image data according to an exemplary embodiment of the present invention, and FIG. 5 is a diagram showing the display data according to an exemplary embodiment of the present invention. In addition, FIG. 6 is a flowchart for explaining the operation of a white pixel detecting unit according to an exemplary embodiment of the present invention.

For example, the image data Im of one frame is shown in FIG. 4, while the display data Dd of one frame is shown in FIG. 5.

Although the image data Im and the display data Dd are shown for the case where the number of pixels P is 56, sizes of the image data Im and the display data Dd are not limited thereto and can be varied according to the number of the pixels P.

In the following, the operations of the image correcting unit 120 will be described by referring to FIGS. 4-6.

When referring to FIG. 4, the image data Im can include a plurality of grayscale values V. Each of the grayscale values V is a value for determining the brightness of its respective pixel P, and each of the pixels P has a corresponding one of the grayscale values V.

The grayscale values V can include a black grayscale value Vb, a white grayscale value Vw, and an intermediate grayscale value Vm which is set as a value between the black grayscale value Vb and white grayscale value Vw.

For example, in the case of 256 grayscales, the black grayscale value Vb can be "0", the white grayscale value Vw can be "255", and the intermediate grayscale value Vm can be a value not less than "1" and not greater than "254".

The pixel P which has received the data signal corresponding to the black grayscale value Vb can display black, the pixel P which has received the data signal corresponding to the white grayscale value Vw can display white, and the pixel P which has received the data signal corresponding to the intermediate grayscale value Vm can display an intermediate grayscale.

Since each of the pixels P according to an exemplary embodiment of the present invention has a high pixel Ph and a low pixel Pl, the respective grayscale values V which are included in the image data Im are converted to a pair of high pixel data H and low pixel data L.

Then, the data driving unit 300 can generate the data signal which corresponds to the high pixel data H and the data signal which corresponds to the low pixel data L, and supply the data signals to the high pixel Ph and the low pixel Pl which are included in the corresponding pixel P, respectively.

In this case, the data converting unit 121 can convert the respective grayscale values V which are included in the image data Im to a pair of high pixel data H and low pixel data L to generate the display data Dd.

For example, the data converting unit 121 can convert the respective grayscale values V to a pair of high pixel data H and low pixel data L by referring to a preset look-up table.

For example, the look-up table can include a plurality of grayscale values V and a plurality of sets of high pixel data H and low pixel data L which correspond to the respective grayscale values V.

When referring to FIG. 5, the display data Dd can include a plurality of high pixel data H and low pixel data L.

For example, the low pixel data L can have a value which is the same as or smaller than that of the high pixel data H.

The data converting unit 121 can convert each of the black grayscale value Vb, white grayscale value Vw, and intermediate grayscale value Vm to a corresponding pair of high pixel data H and low pixel data L.

For example, the data converting unit 121 can convert the black grayscale value Vb to a pair of high pixel data Hb and low pixel data Lb.

In addition, the high pixel data Hb and the low pixel data Lb which have been converted from the black grayscale value Vb can have the same value, for example a "0" value.

For example, the data converting unit 121 can convert the intermediate grayscale value Vm to a pair of high pixel data Hm and low pixel data Lm.

In addition, the low pixel data Lm can have a value smaller than that of the high pixel data Hm.

The high pixel data Hm which is converted from the intermediate grayscale value Vm can have a value between those of the high pixel data Hb, which is converted from the black grayscale value Vb, and second high pixel data H2 which is converted from the white grayscale value Vw.

In addition, the low pixel data Lm which is converted from the intermediate grayscale value Vm can have a value between those of the low pixel data Lb, which is converted from the black grayscale value Vb, and second low pixel data L2 which is converted from the white grayscale value Vw.

For example, the data converting unit 121 can convert the white grayscale value Vw to a pair of second high pixel data H2 and second low pixel data L2.

In addition, the second high pixel data H2 and the second low pixel data L2 can be the same value.

For example, the second high pixel data H2 and the second low pixel data L2 can be the maximum value of the pixel data.

However, when the pixels P, which emit light at the maximum brightness, are concentrated in a specific area, the pixels P, which are adjacent to the specific area, can emit light at a brightness higher than normal.

In other words, when the pixels P, which emit light at the maximum brightness, are concentrated in the specific area, a level of a reference voltage for determining the data signal can rise, and, as a result, the level of the data signal supplied to the pixels P in the adjacent area can also rise, which causes the brightness of the pixels P in the adjacent area to increase.

Therefore, when the white grayscale value Vw is concentrated in a certain area, the image correcting unit 120 according to an exemplary embodiment of the present invention can change the white grayscale value Vw concentrated in the certain area to first high pixel data H1 and first low pixel data L1, instead of changing the white grayscale value Vw to second high pixel data H2 and second low pixel data L2.

In addition, the first high pixel data H1 can have the same value as that of the second high pixel data H2, and the first low pixel data L1 can have a value which is smaller than that of the second low pixel data L2.

In other words, for the white grayscale value Vw which corresponds to a specific condition, it is converted to the first low pixel data L1 which has a value smaller than that of the second low pixel data L2, and, therefore, a variation of the reference voltage for determining the data signal can be suppressed, thereby minimizing erroneous light emission of the pixels P which are positioned in adjacent areas.

To perform the described operations, the white pixel detecting unit 123 can output the conversion signal Sc by analyzing the image data Im, when the image data Im corresponds to the specific condition.

For example, the white pixel detecting unit 123 can receive image data Im of one frame, detect image data lines which include not less than a preset first number Nth1 of white grayscale values from the image data Im, and output the conversion signal Sc when not less than a preset second number Nth2 of the detected image data lines are successively arranged.

For example, when the first number Nth1 is set to "2", and the second number Nth2 is set to "3", the white pixel detecting unit 123 can output the conversion signal Sc corresponding to the image data Im shown in FIG. 4, and the data converting unit 121 can convert the image data Im shown in FIG. 4 to the display data Dd shown in FIG. 5.

In other words, the white pixel detecting unit 123 can detect first, third, fourth, fifth, and seventh image data lines L1, L3, L4, L5, L7 which have at least two white grayscale values Vw from the image data Im.

In addition, the detected first image data line L1 is not positioned in a successive relationship with the other detected image data lines L3, L4, L5, and L7, and the detected seventh image data line L7 also is not positioned in a successive relationship with the other detected image data lines L1, L3, L4, and L5.

However, since the detected third, fourth, and fifth image data lines L3, L4, and L5 are successively arranged in at least three lines, the white pixel detecting unit 123 can output the conversion signal Sc.

When the white pixel detecting unit 123 outputs the conversion signal Sc, the data converting unit 121 can convert the white grayscale values Vw included in the third, fourth, and fifth image data lines L3, L4, and L5, which are successively arranged in at least the second number Nth2 of lines, to the first high pixel data H1 and the first low pixel data L1 which have different values from each other.

In addition, the first low pixel data L1 can have a value which is smaller than that of the first high pixel data H1.

As a result, the data converting unit 121 can convert the white grayscale values Vw included in the third, fourth, and fifth image data lines L3, L4, and L5, which have at least the first number Nth1 of white grayscale values Vw, and are successively arranged in at least the second number Nth2 of lines, to the first high pixel data H1 and the first low pixel data L1.

In addition, the data converting unit 121 can convert the white grayscale values Vw included in the rest of the image data lines L1, L2, L6, and L7 to a pair of the second high pixel data H2 and the second low pixel data L2.

For example, the data converting unit 121 can convert the white grayscale values Vw in the first and seventh image data lines L1 and L7 to a pair of the second high pixel data H2 and the second low pixel data L2. No such conversion is performed on the image data of the second and sixth image data lines L2 and L6, since they do not include white grayscale values.

In addition, the second high pixel data H2 and the second low pixel data L2 can have the same value.

When referring to FIG. 6, the white pixel detecting unit 123 can store the received image data Im in the memory 125 on a line basis (S610).

For example, an external graphic control unit can supply the image data Im to the white pixel detecting unit 123 on the line basis.

The white pixel detecting unit 123 can detect a number Nw of the white grayscale values Vw, which the image data lines stored in the memory 125 include (S620), and determine whether the number Nw of the detected white grayscale values Vw is not less than the preset first number Nth1 (S630).

When the number Nw of the detected white grayscale values Vw is less than the preset first number Nth1, as a result of determination, the white pixel detecting unit 123 can initialize the value of a white count WC to "0" (S640), receive the next image data line, store the next image data line in the memory 125, and perform the preceding steps (S620 and S630) again.

In addition, when the number Nw of the detected white grayscale values Vw is not less than the preset first number Nth1, as a result of determination, the white pixel detecting unit 123 can increment the value of the white count WC by "1" (S650).

Then, the white pixel detecting unit 123 can determine whether the accumulated value of the white count WC is equal to or greater than the preset second number Nth2 (S660).

When the accumulated value of the white count WC is less than the preset second number Nth2, as a result of determination, the white pixel detecting unit 123 can receive the next image data line, store the next image data line in the memory 125, and perform the preceding steps (S620-S660) again.

In addition, when the accumulated value of the white count WC is not less than the preset second number Nth2, the white pixel detecting unit 123 can determine that the specific condition is satisfied, and accordingly output the conversion signal Sc (S670). The specific condition may be that the image data lines, which include not less than the preset first number Nth1 of white grayscale values Vw, are successively arranged in not less than the preset second number Nth2 of lines.

A process of converting the image data Im shown in FIG. 4 to the display data Dd shown in FIG. 5 will be explained in detail by referring to an example where the first number Nth1 is set to "2" and the second number Nth2 is set to "3".

At first, the first image data line L1 which is included in the image data Im is stored in the memory 125.

The white pixel detecting unit 123 calculates the number Nw of the white grayscale values Vw included in the first image data line L1.

Since the first image data line L1 includes two white grayscale values Vw, the white pixel detecting unit 123 can increment the value of the white count WC by "1". This is so, because "2" white grayscale values Vw is greater than or equal to the first number Nth "2".

However, since the current value of the white count WC is "1" and less than the preset second number Nth2, the second image data line L2 is received and stored in the memory 125.

The white pixel detecting unit 123 calculates the number Nw of the white grayscale values Vw included in the second image data line L2.

Since the second image data line L2 does not include any white grayscale value Vw, the white pixel detecting unit 123 initializes the value of the white count WC to "0", receives the third image data line L3 and stores the third image data line L3 in the memory 125.

Since the third image data line L3 includes four white grayscale values Vw, the white pixel detecting unit 123 can increment the value of the white count WC by "1".

However, since the current value of the white count WC is "1" and less than the preset second number Nth2, the fourth image data line L4 is received and stored in the memory 125.

Since the fourth image data line L4 includes four white grayscale values Vw, the white pixel detecting unit 123 can increment the value of the white count WC by "1".

However, since the current value of the white count WC is "2" and less than the preset second number Nth2, the fifth image data line L5 is received and stored in the memory 125.

Since the fifth image data line L5 includes three white grayscale values Vw, the white pixel detecting unit 123 can increment the value of the white count WC by "1".

In this case, since the current value of the white count WC is "3" and not less than the preset second number Nth2, the white pixel detecting unit 123 can output the conversion signal Sc. In other words, because the white count WC of "3" is greater than or equal to the second number Nth2 "3", the white pixel detecting unit 123 can output the conversion signal Sc.

Then, the same operations can be performed for the sixth image data line L6 and the seventh image data line L7. However, since the image data lines L6 and L7 do not satisfy the specific condition, the white pixel detecting unit 123 does output a separate conversion signal Sc.

When the white pixel detecting unit 123 outputs the conversion signal Sc, the data converting unit 121 can convert the white grayscale values Vw included in the image data lines L3, L4, and L5 to a pair of the first high pixel data H1 and the first low pixel data L1, respectively.

In addition, the data converting unit 121 can convert the white grayscale values Vw included in the rest of the image data lines L1, L2, L6, and L7 to a pair of the second high pixel data H2 and the second low pixel data L2, respectively.

It is to be understood that the elements shown in the drawings, particularly the image correcting unit and its constituent parts in FIG. 3, can include electronic circuits.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image correcting circuit, comprising:

a data converting circuit which receives image data, and generates display data by converting respective grayscale values which are included in the image data to high pixel data and low pixel data; and a white pixel detecting circuit which detects image data lines which include not less than a first number of white grayscale values from the image data, and outputs a conversion signal when not less than a second number of the detected image data lines are successively arranged, wherein upon receiving the conversion signal from the white pixel detecting circuit, the data converting circuit converts the white grayscale values which are included in the successively arranged image data lines to first high pixel data and first low pixel data, wherein the first high pixel data and the first low pixel data have a different value from each other.

2. The image correcting circuit of claim 1, wherein the data converting circuit converts the white grayscale values which are not included in the successively arranged image data lines to second high pixel data and second low pixel data, wherein the second high pixel data and the second low pixel data have the same value as each other.

3. The image correcting circuit of claim 2, wherein the first low pixel data has a value smaller than the second low pixel data.

4. The image correcting circuit of claim 2, wherein the first high pixel data has the same value as the second high pixel data.

5. The image correcting circuit of claim 1, wherein the low pixel data which is included in the display data has a value not greater than the high pixel data which is included in the display data.

6. The image correcting unit of claim 1, wherein when the data converting circuit does not receive the conversion signal from the white pixel detecting circuit, the data converting circuit converts all white grayscale values which are included in the image data to second high pixel data and second low pixel data, wherein the second high pixel data and the second low pixel data have the same value as each other.

7. The image correcting circuit of claim 1, further comprising a memory which stores the image data.

8. A liquid crystal display device, comprising:

a plurality of pixels which have high pixels and low pixels, respectively;

an image correcting circuit which receives image data and converts the image data to display data; and a data driving circuit which generates a data signal which corresponds to the display data and supplies the data signal to the pixels, wherein the image correcting circuit includes:

a data converting circuit which receives the image data, and generates the display data by converting respective grayscale values which are included in the image data to high pixel data and low pixel data; and a white pixel detecting circuit which detects image data lines which include not less than a first number of white grayscale values from the image data, and outputs a conversion signal when not less than a second number of the detected image data lines are successively arranged, wherein upon receiving the conversion signal from the white pixel detecting circuit, the data converting circuit converts the white grayscale values which are included in the successively arranged image data lines to first high pixel data and first low pixel data, wherein the first high pixel data and the first low pixel data have a different value from each other.

9. The liquid crystal display device of claim 8, wherein the data converting circuit converts the white grayscale values which are not included in the successively arranged image data lines to second high pixel data and second low pixel data, wherein the second high pixel data and the second low pixel data have the same value as each other.

10. The liquid crystal display device of claim 9, wherein the first low pixel data has a value smaller than the second low pixel data.

11. The liquid crystal display device of claim 9, wherein the first high pixel data has the same value as the second high pixel data.

12. The liquid crystal display device of claim 8, wherein the low pixel data which is included in the display data has a value not greater than the high pixel data which is included in the display data.

13. The liquid crystal display device of claim 8, wherein when the data converting circuit does not receive the conversion signal from the white pixel detecting circuit, the data converting circuit converts all white grayscale values which are included in the image data to second high pixel data and second low pixel data, wherein the second high pixel data and the second low pixel data have the same value as each other.

14. The liquid crystal display device of claim 8, wherein the image correcting circuit further comprises a memory which stores the image data.

15. An image correcting circuit, comprising:

a white pixel detecting circuit that receives image data, wherein the image data includes a plurality of image data lines, each image data line including a plurality of grayscale values, wherein the white pixel detecting circuit detects image data lines having a number of white grayscale values greater than or equal to a first number and outputs a conversion signal when a number of the detected image data lines that are sequentially arranged is greater than or equal to a second number; and a data converting circuit that receives the conversional signal and converts the white grayscale values in the detected image data lines that are sequentially arranged to first high pixel data and first low pixel data.

16. The image correcting circuit of claim 15, wherein the first high pixel data and the first low pixel data are different from each other.

17. The image correcting circuit of claim 15, wherein the data converting circuit converts the white grayscale values of the other image data lines to second high pixel data and second low pixel data.

18. The image correcting circuit of claim 17, wherein the second high pixel data and the second low pixel data are the same as each other.

19. The image correcting circuit of claim 15, wherein the first number is less than the second number.

20. The image correcting circuit of claim 15, wherein the data converting circuit outputs the converted white grayscale values as display data.

* * * * *